US005613718A

United States Patent [19]

Lin

[11] Patent Number: 5,613,718

[45] Date of Patent: Mar. 25, 1997

[54] RETAINING MEANS FOR A DOOR

[76] Inventor: Wuchin Lin, No. 1, Lane 63, Sec. 6 Chunghsiao E. Rd., Taipei, Taiwan

[21] Appl. No.: 639,928

[22] Filed: Apr. 26, 1996

[51] Int. Cl.[6] ..... F05B 17/00

[52] U.S. Cl. ..... 292/346; 292/341.15

[58] Field of Search ..... 292/346, 341.15, 292/340

[56] References Cited

U.S. PATENT DOCUMENTS

| | | | |
|---|---|---|---|
| 521,458 | 6/1894 | Burns | 292/346 |
| 1,867,694 | 7/1932 | Cramer | 292/341.15 |
| 1,919,739 | 7/1933 | Minzenmayer | 292/341.15 |
| 3,449,006 | 6/1969 | Petri | 292/341.15 |

FOREIGN PATENT DOCUMENTS

| | | | |
|---|---|---|---|
| 682644 | 3/1964 | Canada | 292/341.15 |

*Primary Examiner*—Rodney M. Lindsey
*Attorney, Agent, or Firm*—Bacon & Thomas

[57] ABSTRACT

A retaining means for a door having a body, a resilient means, a locking means and a controlling means is able to prevent people from opening a door with sharp tools when the door is closed. The locking means is able to limit a latch of the door when the locking means projects out from the body due to the resilience of the resilient means. Pulling the controlling means will then urge the locking means toward the body and into a receiving cavity, such that the door will be easily opened after retrieving the latch into the door.

2 Claims, 3 Drawing Sheets

RETAINING MEANS FOR A DOOR

FIELD OF THE INVENTION

The present invention generally relates to a retaining means, and more particularly to a retaining means which can be mounted onto a lock originally fixed on a door without altering any element of the lock or of the door.

BACKGROUND OF THE INVENTION

This invention has a particular application to a retaining means which can be used together with a lock originally fixed on a door.

Locks have been widely used in the architectural industry for the purpose of retaining door in an opening or locking status. Yet, most of the locks using latches to keep the door in a locking status are not perfect designs, because a gap still exists between a jamb and a lock. Thus, an intruder will easily break into a house using simple tool. For overcoming the drawbacks of the prior locks, people then provide a chain to let the door open but still in a retained manner.

Although such a design works well, it needs extra work to mount the chain onto the door and thus will somewhat damage the jamb.

Therefore, the present invention provides an improved retaining means having a body, locking means, resilient means, and a controlling means. The body is configured to have two extensions each having a hole therein and extending upwardly and downwardly. The body further comprises a sliding plate extending latitudinally and a receiving hole having two sliding recesses configured respectively on a sidewall. The locking means is configured and defined to be sliding movable within the receiving hole of the body. A recess is configured within the locking means for receiving a resilient means therein, such that the locking means will be pushed away from the body by the resilient means when the compression of the controlling means on the locking means is released. On a contrary side of the recess, a surface is configured thereon for receiving a latch when a door is in a locking position. A protrusion with several linked beveled surfaces and a positioning edge adjacent to said beveled surfaces is formed respectively on an upper end and a lower end of the locking means. The controlling means is a "U" shaped plate having a curved portion at its opposite end to an opening of the "U" shape and has a first leg and a second leg. The first leg and the second leg individually have a projection and an "L" shaped boss; the projection is configured orthogonally to the first leg and the second leg and is provided with an inclined surface corresponding to said beveled surface of the locking means. The projection is further provided with a sliding boss formed opposite to the direction of the outer sliding boss on the second leg.

Thus, the retaining means of the present invention tends to mitigate and/or obviate the aforementioned problems.

SUMMARY OF THE INVENTION

The main objective of the invention is to provide a retaining means which can be used together with a lock originally mounted on a jamb and conveniently need no extra work on the door, so that no damage will be do to the jamb.

In accordance with the present invention, another objective is to provide a retaining means which increases the security to a door by diminishing the gap between a door and a jamb.

Other objects, advantages and novel features of the invention will become more apparent from the following detailed description when taken in conjunction with the accompanying drawings.

BRIEF DESCRIPTION OF THE DRAWINGS

The present invention will now be better understood with the reference of the accompanying drawings wherein.

DETAILED DESCRIPTION OF THE PREFERRED EMBODIMENT

Figure 1:
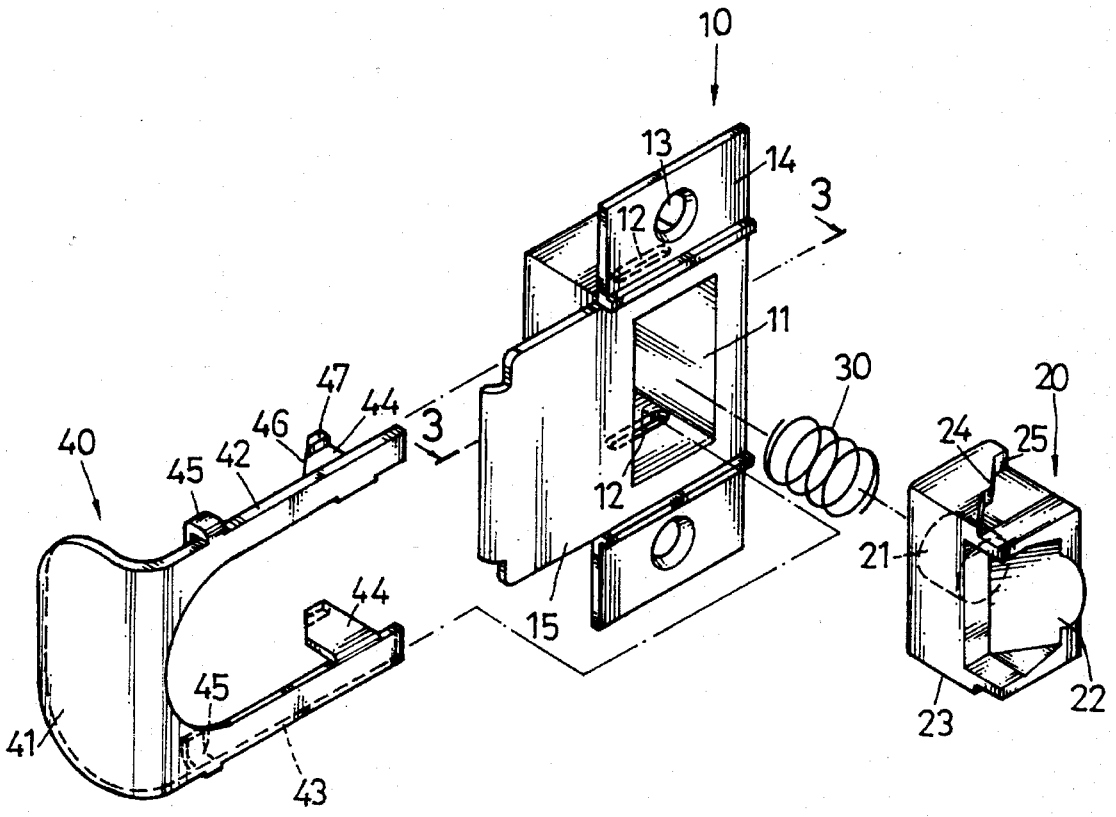
FIG. 1 is an exploded view of retaining means constructed in accordance with the present invention.

Referring to the drawings and particularly FIGS. 1, a retaining means is provided. A retaining means having a body 10, a locking means 20, a resilient means 30, and a controlling means 40. The body 10 is configured to have two extensions 14 respectively at a top and a bottom end thereof each having a hole 13 therein and extending upwardly and downwardly at a same plane respectively. The body 10 further comprises a sliding plate 15 extending latitudinally and a receiving cavity 11 having two sliding recesses 12 configured respectively in an upper and lower sidewalls thereof. The locking means 20 is configured to be slidably moving within the receiving cavity 11 of the body 10. A recess 21 is configured within the locking means 20 for receiving the resilient means 30 therein, such that the locking means 20 will be pushed away from the body 10 when the compression on the resilient means 30 is released. On a contrary side of the recess 21, a surface 22 is configured thereon for receiving a latch (not shown) when a door (not labeled) is in a locking position. A protrusion 23 With several beveled surfaces 24 and a positioning edge 25 adjacent to said beveled surfaces 24 is formed respectively on an upper end and a lower end of the locking means 20. The controlling means is a "U" shaped plate having a curved portion 41 and has a first leg 42 and a second leg 43. The first leg 42 and the second leg 43 individually have a projection 44 and a L shaped boss 45; the projection 44 is configured orthogonally to the first leg 42 and the second leg 43 and is provided with an inclined surface 46 corresponding to said beveled surface 24 of the locking means 20. The projection 44 is further provided with a sliding boss 47 formed opposite to the direction of the other sliding boss 47 on the second leg 43.

Figure 2:
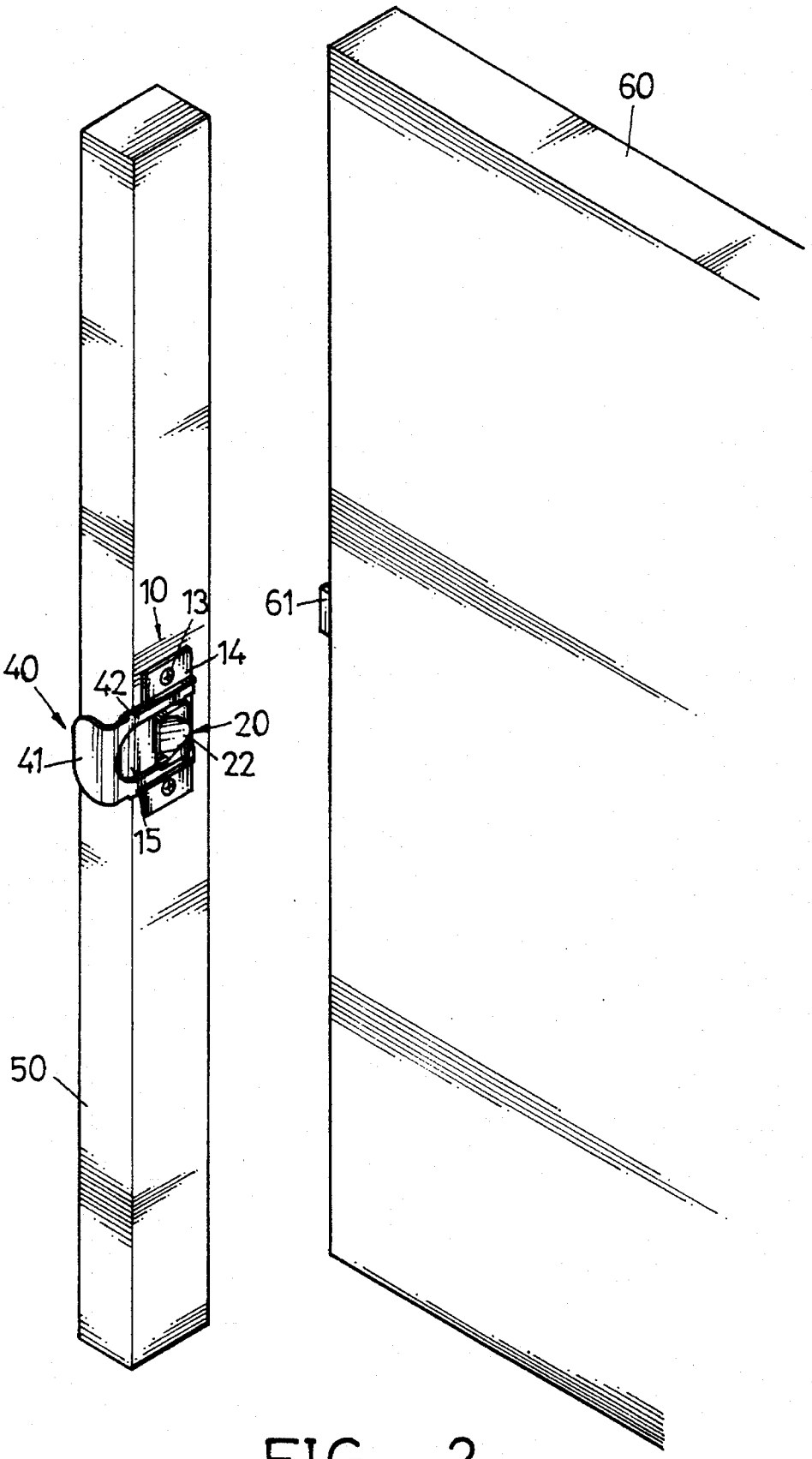
FIG. 2 is one preferred embodiment of the invention showing the retaining means mounted on a jamb.

In FIG. 2 and taking FIG. 1 as reference, it is noted that a retaining means constructed in accordance with the present invention is assembled together and mounted on a jamb 50. When in assembly, the body 10 is mounted onto a jamb 50 with screws extending through the holes 13, and the inclined surface 46 of the controlling means 40 is firstly abutted against the beveled surface 24, and the resilient means 30 is received within the recess 21, then by pressing the locking means 20 into the receiving cavity 11 with the controlling means 40, the sliding plate 15 of the body 10 is received within a space defined by two bosses 45. As pressure is maintained on the locking means 20 to urge it into the receiving cavity 11 of the body 10, the individual sliding boss 47 of each of the first leg 42 and the second leg 43 of the controlling means 40 will be received and limited within the sliding recess 12. Thus, by pulling the controlling means 40 back and forth, the locking means 20 will then slidably move in the receiving cavity 11 with the resilience of the resilient means 30.

Figure 3:
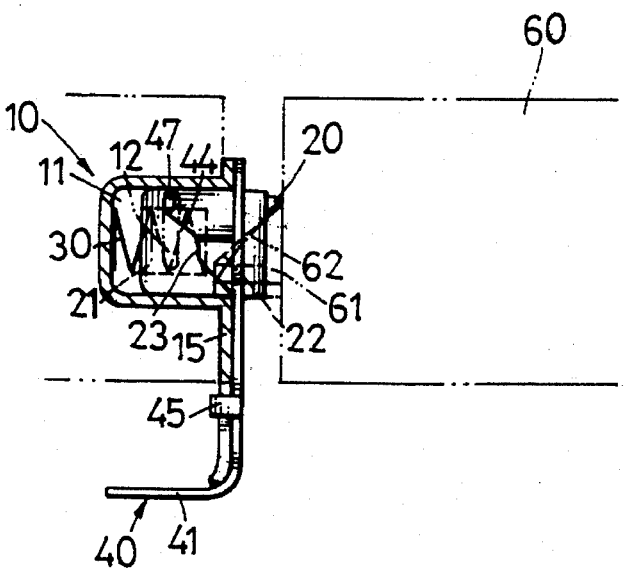
FIG. 3 is a sectional view taken line 3—3 of FIG. 1 showing that a latch is received within a receiving hole of a locking means.

Referring to FIG. 3, the locking means 20 projects out from the receiving cavity 11, and a tilting side 62 of a latch 61 of a door 60 rests against the surface 22, when the sliding boss 47 stops at the positioning edge 25, And the resilient means 30 is not under pressure. When the door is in a locking position, the surface 22 of the locking means 20 is able to prevent the latch 61 from being damaged by sharp tools.

Figure 4:
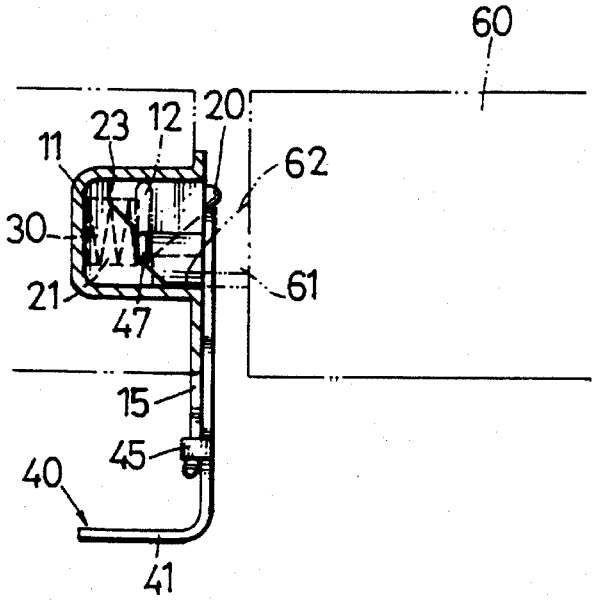
FIG. 4 is another sectional view of FIG. 3 showing a resilient means is being compressed by the blocking means when the controlling means is pulled by a user.

Referring to FIG. 4, since the beveled surface 24 is abutted against the inclined surface 46, pulling the controlling means 40 with the sliding boss 47 along the sliding recess 12 and the boss 45 along the sliding plate 15 will urge the locking means 20 inward, therefore, retrieving the latch 61 into a door 60 will then be able to open the door 60.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A retaining means comprising:

a body having a sliding plate extending latitudinally, a receiving cavity with two sliding recesses individually configured on an upper face and a lower face and two extensions each having a hole therein and extending longitudinally from said body;

a resilient means received within said receiving cavity;

a locking means slidably received within said receiving cavity, having a recess therein for receiving said resilient means, a surface opposite to said recess for receiving a latch, and a plurality of beveled surfaces and a positioning edge;

a controlling means for pressing and releasing said locking means, having a first leg, a second leg each having an "L" shaped boss having said sliding plate of said body slidably connected therein, said first leg and said second leg each being orthogonally configured to have an inclined surface corresponding to said beveled surface and a sliding boss slidably received within said sliding recess.

2. The retaining means as claimed in claim 1, wherein said sliding boss of said first leg and said sliding boss of said second leg are oriented away from each other.

* * * * *